United States Patent [19]

Schwalenstocker, Jr.

[11] 4,036,649

[45] July 19, 1977

[54] SILVER HALIDE EMULSION SENSITIZED WITH A FUSED DIAZEPINE

[75] Inventor: Henry John Schwalenstocker, Jr., Pittsford, N.Y.

[73] Assignee: E. I. Du Pont de Nemours and Company, Wilmington, Del.

[21] Appl. No.: 696,915

[22] Filed: June 17, 1976

[51] Int. Cl.[2] ..... G03C 1/28

[52] U.S. Cl. ..... 96/107

[58] Field of Search ..... 96/107, 101, 120, 127

[56] References Cited

U.S. PATENT DOCUMENTS

| | | | |
|---|---|---|---|
| 3,124,458 | 3/1964 | Fry et al. | 96/101 |
| 3,615,607 | 10/1971 | Soma et al. | 96/107 |
| 3,945,832 | 3/1976 | Shiba et al. | 96/107 |

OTHER PUBLICATIONS

Chemical Abstracts, 7th Collective Index, p. 7376s and vol. 59, 9478g.

*Primary Examiner*—Won H. Louie, Jr.

[57] ABSTRACT

Photographic silver halide emulsions which have their sensitivity increased by the addition of a fused diazepine.

9 Claims, No Drawings

SILVER HALIDE EMULSION SENSITIZED WITH A FUSED DIAZEPINE

BACKGROUND OF THE INVENTION

Silver halide photographic emulsions in their primitive state are typically too insensitive and low in contrast for use in practical application. Emulsions of fine grain size (under about 0.5μ mean grain diameter) in particular are relatively insensitive but offer advantages such as high covering power and resolution. Many methods of increasing the sensitivity of silver halide photographic emulsions have been advanced. These methods fall into two general classes:

1. chemical sensitization in which the emulsion is digested with agents such as sulfur compounds, reducing agents, salts of noble metals, and combination of such agents, to bring about a chemical change in the surface of the silver halide grain;
2. optical or spectral sensitization in which sensitizing dyes are incorporated into the emulsion, resulting in an increase in the range of spectral sensitivity of the system.

The first method, chemical sensitization, usually provides only moderate speed increases before reaching a point at which further increases in sensitizer result in undesirable side effects such as poor keeping quality and fog. The second method, spectral sensitization, provides greater speed increases by extending the spectral range of sensitivity, but it is only effective when the energy of the exposing source includes wavelengths absorbed by the sensitizer. In addition, spectral sensitization may result in safelight fog unless the materials are handled only in total darkness.

SUMMARY OF THE INVENTION

It has been discovered that the speed and contrast of a negative-working silver halide photographic emulsion can be substantially increased by the inclusion of a fused diazepine having the following generic formula:

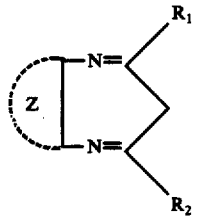

wherein $R_1$ and $R_2$ may be the same or different and are selected from the group consisting of hydrogen, lower alkyl, or aryl groups. Preferred lower alkyl groups are within the range of 1 to 4 carbon atoms and preferred aryl groups are phenyl. Z represents the nonmetallic atoms necessary to complete a fused aromatic ring or a polycyclic ring structure of up to ten atoms which may contain hetero atoms, preferably nitrogen, and may contain substituent groups such as halogen, preferably chlorine, and alkyl, preferably $C_1$–$C_4$. Salts of the diazepine are equally useful in this invention.

DETAILED DESCRIPTION OF THE INVENTION

The sensitizers defined herein can be used to sensitize a wide variety of negative-working, developing-out silver halide emulsions. Their concentration may be varied over a wide range depending upon the intended purpose, preferably 0.5 to 700 milligrams of fused diazepine per mole of silver halide. Of course, some of these compounds will be more effective than others when used in equivalent quantities and the proper amount may be determined by simple testing, a procedure well-known to those skilled in the art.

The following are examples of diazepines which are particularly suitable for the practice of this invention:

(A)

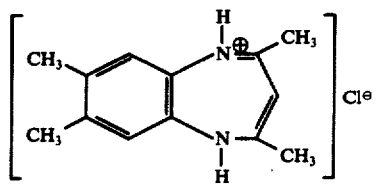

2,4,7,8-tetramethyl-1H-1,5-benzodiazepine monohydrochloride m.p. 240° C, dec.

(B)

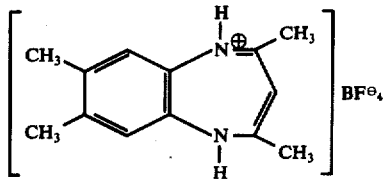

2,4,7,8-tetramethyl-1H-1,5-benzodiazepine mono(tetrafluoroborate 1-) m.p. 230° C, dec.

(C)

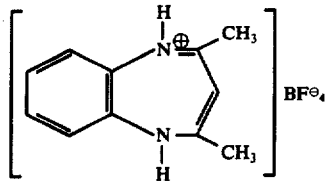

2,4-dimethyl-1H-1,5-benzodiazepine mono-(tetrafluoroborate 1) m.p. 220° C, dec.

-continued

| | | |
|---|---|---|
| (D) | 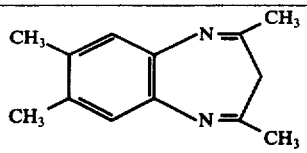 | 2,4,7,8-tetramethyl-3H-1,5-benzodiazepine m.p. 151–153° C |
| (E) | 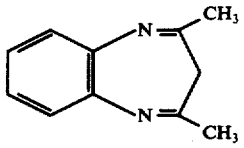 | 2,4-dimethyl-3H-1,5-benzodiazepine m.p. 134–136° C |
| (F) | 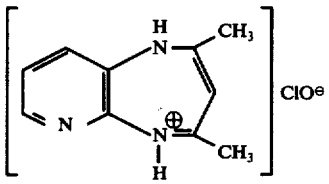 | 2,4-dimethyl-1H-pyrido-(2,3-b)(1,4)diazepine monoperchlorate m.p. 245–247° C., dec. |
| (G) | 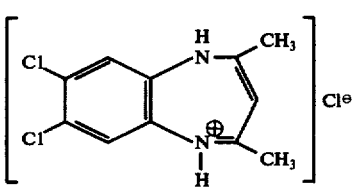 | 2,4-dimethyl-7,8-dichloro-1H-1,5-benzodiazepine monohydrochloride m.p. 269–271° C., dec. |
| (H) | 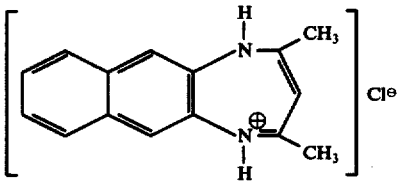 | 2,4-dimethyl-1H-naphtho-(2,3-b)(1,4) diazepine monohydrochloride m.p. 256–260° C., dec. |
| (I) | 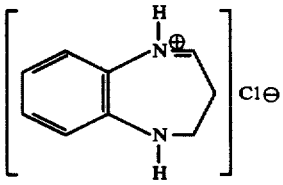 | 1H-1,5-benzodiazepine monohydrochloride m.p. 196–198° C., dec. |
| (J) | 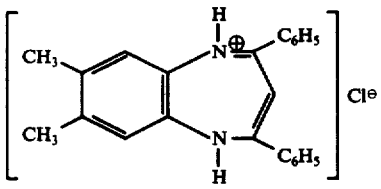 | 2,4-diphenyl-7,8-dimethyl-1H',5-benzodiazepine monohydrochloride m.p. 200–205° C. |

Methods of preparation of benzodiazepines are well known, e.g., see:

J. Thiele and G. Steimmig, Ber. Deut. Chem., 40, 955 (1907);

G. Schwarzenbach and K. Lutz, Helv. Chim. Acta, 23, 1139. 1147 (1940);

J. A. Barltrop, C. G. Richards, D. M. Russell and G. Ryback, J. Chem. Soc., 1132 (1959);

J. O. Halford and R. M. Fitsch, J. Amer. Chem. Soc., 85, 3354 (1963);

D. Lloyd, R. H. McDougall and D. R. Marshall, J. Chem. Soc., 3785 (1965).

The increase in sensitivity obtained by the use of these novel sensitizers is far greater than that normally obtained by conventional chemical sensitization, yet without the extension in spectral sensitivity range usually associated with spectral sensitization. Moreover, this sensitivity increase is obtained without an increase in fog and it is accompanied by a marked increase in contrast.

The diazepines have also been found to stabilize against speed loss on aging, e.g., in chemically sensitized iodobromide emulsions when added at levels of 0.5 to 7 mg/mole of silver halide.

The novel sensitizers of this invention may be used as the sole sensitizer in the silver halide emulsion or they may be used in conjunction with other known sensitizers; e.g., labile sulfur compounds or precious metal compounds. In addition, they can be sensitized with optical sensitizing dyes; e.g. cyanines, carbocyanines, merocyanines, etc. Additive speed increases have been found when diazepines are used in conjunction with other sensitizers. A single diazepine compound or a mixture of diazepine compounds may be used in sensitizing amounts depending on the degree of sensitivity desired, the particular type of silver halide emulsion, the degree of ripening, the stage of emulsion preparation at which the sensitizer is added, and the other sensitizers and adjuvants present.

The sensitizers of the invention can be added to the silver halide emulsion at any stage of its preparation but in a preferred embodiment they are added after digestion, immediately prior to the coating. They require no special final digestion or after-ripening. They may also be added to a coated layer of the emulsion.

The sensitizers of the invention can be added to photographic silver halide emulsions using any of the well-known techniques in emulsion making. For example, they can be dissolved in a suitable solvent such as ethanol or methanol and added to the silver halide emulsion, or the solids can be added directly to the emulsion since many of them are sparingly water-soluble. The solvent should be selected so that it has no harmful effect upon the emulsion, and generally solvents or diluents which are miscible with water are to be preferred.

The speed and contrast increase obtainable with the invention is particularly useful with fine grain emulsions, especially silver bromide and iodobromide emulsions. Preferred embodiments therefore include a silver halide emulsion having an average grain diameter of no more than 0.5 micron, and particularly silver bromide and iodobromide emulsions so sensitized.

Silver halide emulsions sensitized according to this invention can also contain conventional additives such as plasticizers for the colloid carrier in which the silver halide crystals are dispersed, antifoggants such as thiazoles, triazoles, tetrazaindenes and the like, coating aids, hardeners, etc. Various silver salts may be used as the light-sensitive medium such as silver bromide, silver iodide, silver chloride or mixed silver halides such as silver chlorobromide, silver iodobromide, and silver iodobromochloride.

The silver halide emulsions of this invention can be made with any of the macromolecular, water-permeable colloids known to be suitable for the purpose of acting as a colloid carrier for silver halide grains. A conventional colloid binder useful for this purpose is gelatin.

The silver halide emulsions of this invention may be coated on any suitable support including photographic quality paper and transparent film. For example, the cellulosic supports such as cellulose nitrate, cellulose acetate, cellulose triacetate, cellulose mixed esters, etc., may be used. Polymerized vinyl compounds, e.g., copolymerized vinyl acetate and vinyl chloride, polystyrene, and polymerized acrylates may also be used; also the film formed from certain polyesters, preferably those obtainable by condensing terephthalic acid or dimethyl terephthalate with diethylene glycol. The emulsions are generally coated on the supports to give a coating weight of about 20–100 mg/dm$^2$ of silver halide when dry.

The sensitizing and contrast-increasing effects of the fused diazepines are illustrated in the following examples:

EXAMPLE I

A fine-grain (less than 0.2 micron mean grain diameter) gelatino-silver iodobromide emulsion containing approximately 2.5 mole % iodide was digested for 60 min. at 160° F. in the presence of 2.61 mg. of hydrogen tetra chloroaurate per mole of silver halide. Prior to coating (after digestion), the emulsion was divided into parts and these were treated by the addition of different amounts of a 0.1% solution of benzodiazepine compound A in ethanol such that the concentration of compound A in the emulsion varied from about 165 to about 660 milligrams per mole of silver halide. The emulsion samples were then individually coated on photographic film support and dried; one coating being made from emulsion with no additive as a control. The sensitometric properties of the coatings were determined in the usual way by exposure with a tungsten source and developed in a continuous tone developer.

The sensitometric characteristics of the various emulsion samples are shown in the following table:

| Coating | Additive | Milligrams Compound A per mole Ag | Relative Speed[1] | Gamma[2] | Base + Fog |
|---|---|---|---|---|---|
| Control | None | — | 1 | 1.2 | .03 |
| 1 | Compound A | 165 | 8.2 | 3.6 | .03 |
| 2 | Compound A | 330 | 19.1 | 4.8 | .03 |
| 3 | Compound A | 660 | 36.9 | 6.4 | .03 |

[1]Based on exposure required to produce transmission density 0.3.
[2]Gamma is defined as the slope of the straight line portion of the characteristic curve and is a measure of the contrast of the image.

These data show that the speed and contrast of the emulsion substantially increased, with no increase in fog, by the addition of diazepine compound A.

EXAMPLE II

The fine-grain silver iodobromide emulsion described in Example I was divided into several parts prior to coating and different parts were treated by the addition of compounds B, C, D & E so that the concentration of the compound added ranges from approximately 330 mg. to 660 mg/mole silver halide. Sensitometric characteristics of the samples tested as in Example I are shown in the following table:

| Coating | Compounds Added | Milligrams of Compound per mole Ag | Relative Speed | Gamma | Base + Fog |
|---|---|---|---|---|---|
| Control | None | None | 1 | 2.3 | .02 |
| 4 | B | 330 | 21 | 3.7 | .02 |
| 5 | B | 660 | 40 | 5.0 | .02 |
| 6 | C | 330 | 23 | 3.3 | .02 |
| 7 | C | 660 | 85 | 4.4 | .03 |
| 8 | D | 330 | 23 | 4.7 | .02 |
| 9 | D | 660 | 43 | 5.2 | .02 |
| 10 | E | 330 | 25 | 4.1 | .02 |
| 11 | E | 660 | 82 | 5.1 | .03 |

These data demonstrate a speed increase of as much as 85 times that of the control without an unacceptable increase in fog and show that the diazepine bases and salts are equally effective.

EXAMPLE III

The fine-grain silver iodobromide emulsion described in Example I was prepared for coating without chemical sensitizers (e.g. gold or sulfur compounds). Prior to coating it was divided into different parts which were treated by the addition of compounds F, G and H so that the concentration of compound added ranged from approximately 133 mg. to 266 mg./mole silver halide. Sensitometric characteristics of the samples tested are shown in the following table:

| Coating | Compounds Added | Milligrams of Compound per mole Ag | Relative Speed | Gamma | Base + Fog |
|---|---|---|---|---|---|
| Control | None | None | 1.0 | 1.0 | .01 |
| 12 | F | 133 | 1.7 | 1.3 | .01 |
| 13 | F | 266 | 1.8 | 1.3 | .01 |
| 14 | G | 133 | 21.4 | 3.3 | .01 |
| 15 | G | 266 | 23.6 | 3.7 | .01 |
| 16 | H | 133 | 1.6 | 1.7 | .01 |

These data demonstrate a speed increase of as much as 24 times that of the control without an increase in fog when a diazepine is the only sensitizer present. They further demonstrate that diazepines other than benzodiazepines act as sensitizers, albeit less effective.

EXAMPE IV

The fine-grain iodobromide emulsion described in Example I was coated on film base and dried. Samples of the coating were then dipped into a solution of Compound A in ethanol at a concentration of 0.05 g/liter for 1 min. The treated coating was then dried, exposed, processed and evaluated in the usual way. A similar sample was treated in the same way, after exposure, but before processing. The sensitometric characteristics of these trials are compared with those of an untreated coating in the following table:

| Test | Treatment | Relative Speed | Gamma | Base + Fog |
|---|---|---|---|---|
| Control | None | 1.0 | 1.7 | .02 |
| 19 | Dip in Compound A Sol. before Exposure | 9.3 | 4.0 | .02 |
| 20 | Dip in Compound A Sol. after Exposure | 1.0 | 1.7 | .02 |

It can be seen that treatment of the coated film prior to exposure shows the same kind of activity that is obtained by adding Compound A directly to the emulsion, suggesting that the compound is strongly adsorbed to silver halide, thereby affecting the sensitivity to exposing light. The fact that treatment after exposure has no effect indicates that the mechanism of sensitization does not involve the development step.

EXAMPLE V

The fine-grain silver iodobromide emulsion described in Example I was divided into separate parts before digestion. Half of the emulsion was treated by adding 2.9 mg. of sodium thiosulfate and 1.38 mg. of hydrogen tetrachloroaurate per mole of silver, as chemical sensitizers, the other half received no chemical sensitizer. Each half was then digested for 30 min. at 130° F. following which diazepines were added to portions of the emulsion as shown below. The portions were coated on film base, dried and tested as before. Sensitometric characteristics of the samples tested are shown in the following table:

| Coating | Sensitization | Diazepine | Relative Spd. at 0.3 Density | Gamma | Base + Fog Dens. |
|---|---|---|---|---|---|
| Control | None | None | 1 | 2.0 | .01 |
| 21 | None | 133 mg. Cpd.B/mole Ag | 20.9 | 4.9 | .02 |
| 22 | None | 133 mg. Cpd.I/mole Ag | 5.6 | 4.9 | .01 |
| Control | $Na_2S_2O_3$/Gold | None | 5.6 | 2.5 | .01 |
| 23 | $Na_2S_2O_3$/Gold | 133 mg. B/mole Ag | 41.7 | 5.3 | .07 |
| 24 | $Na_2S_2O_3$/Gold | 133 mg.I/mole Ag | 14.8 | 5.0 | .02 |

EXAMPLE VI

The fine-grain silver halide emulsion described in Example I was made with the iodide being omitted during its manufacture, the resulting emulsion being entirely silver bromide. This emulsion was treated at digestion as described in Example V. Sensitometric characteristics of the samples tested are shown in the following table:

| Coating | Sensitization | Diazepine | Relative Speed | Gamma | Base + Fog |
|---|---|---|---|---|---|
| Control | None | None | 1 | 2.8 | .02 |
| 25 | None | 133 mg. B/mole Ag | 15.8 | 6.0 | .02 |
| 26 | None | 133 mg. I/mole Ag | 4.4 | 5.3 | .02 |
| Control | $Na_2S_2O_3$/Gold | None | 2.6 | 3.0 | .02 |
| 27 | $Na_2S_2O_3$/Gold | 133 mg. B/mole Ag | 44.7 | 5.3 | .04 |
| 28 | $Na_2S_2O_3$/Gold | 133 mg. I/mole Ag | 9.8 | 5.0 | .02 |

The data of Examples V and VI demonstrate that both Compound B and Compound I are effective sensitizers and contrast agents in either bromide or iodobromide emulsion and that they can be used in combination with common chemical sensitizers to give enhanced speed and contrast.

EXAMPLE VII

The fine-grain silver iodobromide emulsion described in Example I was divided into two parts prior to coating and one part was treated by the addition of Compound J. Sensitometric characteristics of the samples tested are shown below.

| Additive | Milligrams Compound per mole Ag | Relative Speed at 0.3D | Avg. Gradient | Base + Fog |
|---|---|---|---|---|
| None | — | 1 | 2.4 | .02 |
| Compound J | 133 | 1.9 | 3.0 | .02 |

These data demonstrate some sensitizing activity for an aryl-substituted benzodiazepine, without an increase in fog.

I claim:

1. A photographic element comprising a support bearing a layer of a negative-working, developingout, silver halide emulsion containing a sensitizing amount of either a) at least one fused diazepine of the formula

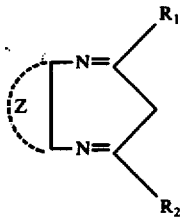

wherein $R_1$ and $R_2$ may be the same or different and are selected from the group consisting of H, $C_1$–$C_4$ alkyl, and phenyl; and Z represents the non-metallic atoms necessary to complete an aromatic ring structure selected from the group consisting of benzene, pyridine, and naphthalene, which aromatic ring structure may contain halogen or lower alkyl groups as ring substituents; and b) a salt of said diazepine.

2. The photographic element of claim 1 wherein said diazepine is present in an amount of from 0.50–700 milligrams per mole of silver halide.

3. The photographic element of claim 1 wherein said diazepine is selected from the group consisting of 1,5-benzodiazepine; 2,4-dialkyl-3H-1,5-benzodiazepine; 2,4,7,8-tetraalkyl-3H-1,5-benzodiazepine, and salts of the foregoing compounds.

4. The photographic element of claim 1 wherein said diazepine is 2,4,7,8-tetramethyl-1H-1,5-benzodiazepinium monohydrochloride.

5. The photographic element of claim 1 wherein said diazepine is 2,4-dimethyl-1H-1,5-benzodiazepinium mono(tetrafluoroborate-1).

6. The photographic element of claim 1 wherein said diazepine is 2,4,7,8-tetramethyl-3H-1,5-benzodiazepine.

7. The photographic element of claim 1 wherein said diazepine is 2,4-dimethyl-3H-1,5-benzodiazepine.

8. The photographic element of claim 1 wherein the silver halide emulsion has an average grain diameter of no more than 0.5 microns.

9. A process for preparing the photographic element of claim 1 which consists essentially of adding the fused diazepine to the silver halide emulsion prior to coating on a support.

* * * * *